United States Patent [19]

Toma

[11] Patent Number: 4,817,298

[45] Date of Patent: Apr. 4, 1989

[54] FABRIC DRYER WITH IMPROVED BLOWER ASSEMBLY

[75] Inventor: Daniel N. Toma, Georgetown, Ind.

[73] Assignee: General Electric Company, Louisville, Ky.

[21] Appl. No.: 132,871

[22] Filed: Dec. 14, 1987

[51] Int. Cl.[4] ..... F26B 11/04

[52] U.S. Cl. ..... 34/133; 34/139

[58] Field of Search ..... 34/133, 235, 131, 132, 34/139

[56] References Cited

U.S. PATENT DOCUMENTS

| | | | |
|---|---|---|---|
| 3,513,566 | 5/1970 | Shacklock et al. | 34/133 |
| 3,584,393 | 10/1969 | Menk | 34/133 |
| 3,789,514 | 2/1974 | Faust et al. | 34/82 |
| 3,816,942 | 6/1974 | Smith | 34/242 |
| 3,892,048 | 7/1975 | Jacobsen, Jr. | 34/133 |
| 4,213,250 | 7/1980 | Hawkins | 34/133 |
| 4,586,269 | 5/1986 | St. Louis | 34/133 |

*Primary Examiner*—Henry A. Bennet

*Attorney, Agent, or Firm*—Radford M. Reams; Frederick P. Weidner

[57] ABSTRACT

A fabric dryer includes an improved blower assembly, incorporating a tangential blower wheel and a blower housing formed by parts which serve additional functions in the dryer housing. The blower wheel is mounted forward of and the blower motor is mounted rearward of the panel supporting the front of the dryer drum. A member bridging between the front wall of the dryer housing and the front of the drum includes an elongated wall extending between and engaging the drum support panel and the housing front wall to form the blower housing and exit conduit for air leaving the blower housing.

12 Claims, 4 Drawing Sheets

FABRIC DRYER WITH IMPROVED BLOWER ASSEMBLY

BACKGROUND OF THE INVENTION

A typical automatic fabric or clothes dryer includes a drum rotatable about a horizontal axis to receive clothes or other fabrics to be dried. During operation the drum is rotated and heated air passes through the drum from the rear to the front to extract moisture from the fabrics. This air then passes through a filter to remove lint and exhausts from the dryer housing. The filter normally is at the front of the dryer for ease of cleaning and the air normally is exhausted from the rear portion of the dryer as an aid in exhausting the air to the outside of the building. Typically air flow through the dryer is provided by a centrifugal blower. Centrifugal blowers are relatively bulky and the direction of air flow through them changes from parallel to the blower wheel axis to perpendicular to the blower axis. This tends to cause the blower and immediately adjacent conduit to be relatively large.

It is desirable to mount the drum with its open front end fairly close to the front wall of the dryer housing to provide maximum drum size in a given housing size. The relatively large size of the centrifugal blower required for a given air flow results in the blower and its housing normally being positioned behind the panel or other structure supporting the front of the drum. Additional conduit structure is used to guide the air from the front of the drum and filter to the blower.

It is an object of this invention to provide a fabric dryer which effectively utilizes a tangential blower for air flow.

It is a further object of this invention to provide a fabric dryer in which the housing for the air blower and the adjacent air flow conduit are formed by using components normally used in the dryer for other purposes.

It is a further object of this invention to provide an improved fabric dryer which makes better use of space and materials.

SUMMARY OF THE INVENTION

In accordance with one form of the present invention there is provided a fabric dryer including a dryer housing having a rear wall, a pair of spaced apart side walls and a front wall. A fabric receiving drum is mounted in the housing for rotation about a generally horizontal axis with its open front spaced from the front wall of the dryer housing. A support panel positioned rearwardly of the front wall supports the front of the drum. A blower mechanism for drawing air through the drum and discharging the air from the dryer housing includes a drive motor mounted rearwardly of the support panel and a tangential blower wheel mounted forwardly of the support panel. A bridging member extends between and engages the support panel and the dryer housing front wall to form a blower housing and conduit for air exiting the blower housing.

Some aspects of the illustrative fabric dryer shown and described in the present application are common with copending application Ser. No. 132,872, filed for Daniel N. Toma and Thomas P. Mitchell and assigned to General Electric Company, assignee of the present invention. However the inventions claimed in these applications are separate and distinct.

DESCRIPTION OF THE PREFERRED EMBODIMENTS

Figure 1:
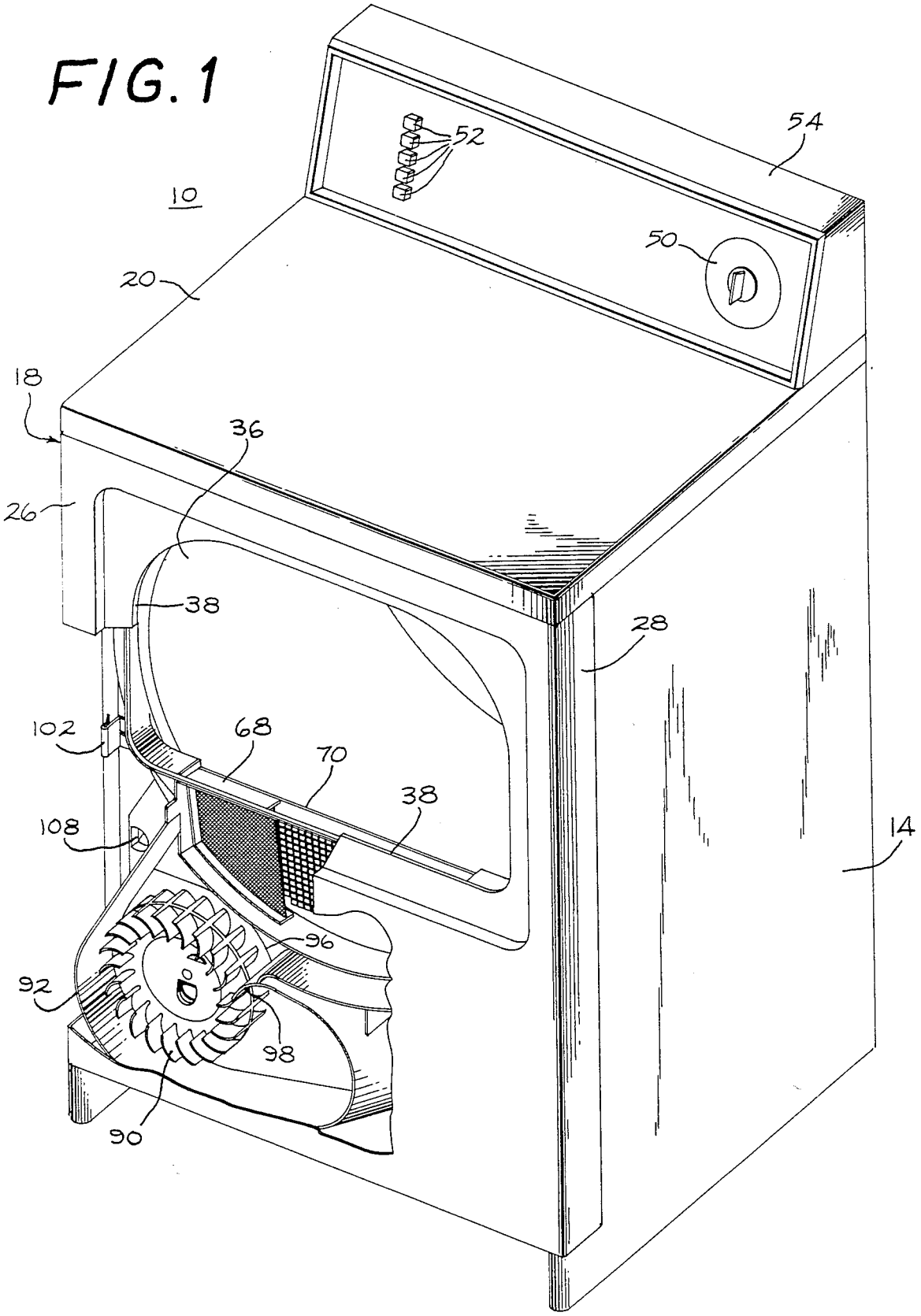
FIG. 1 is a front perspective view of a fabric dryer incorporating one form of the present invention, the view being partly broken away to illustrate details and somewhat schematic for ease of reference.

Referring now to the drawings, there is illustrated a domestic clothes or fabric dryer generally indicated by the numeral 10. The dryer 10 is provided, in the usual way, with a housing or cabinet having a rear wall 12, a pair of spaced apart side walls 14 and 16, a front panel 18, a top 20 and bottom panel 22. Conveniently the rear and side walls 12, 14 and 16 may be formed by bending a continuous sheet of metal. The front panel 18 is formed as a separate member and may, in fact, be slightly shorter than the rear and side walls so as to be mounted on a spacer 24 at the front of the bottom pan. This provides room, normally called a kickspace, below the front panel.

Figure 2:
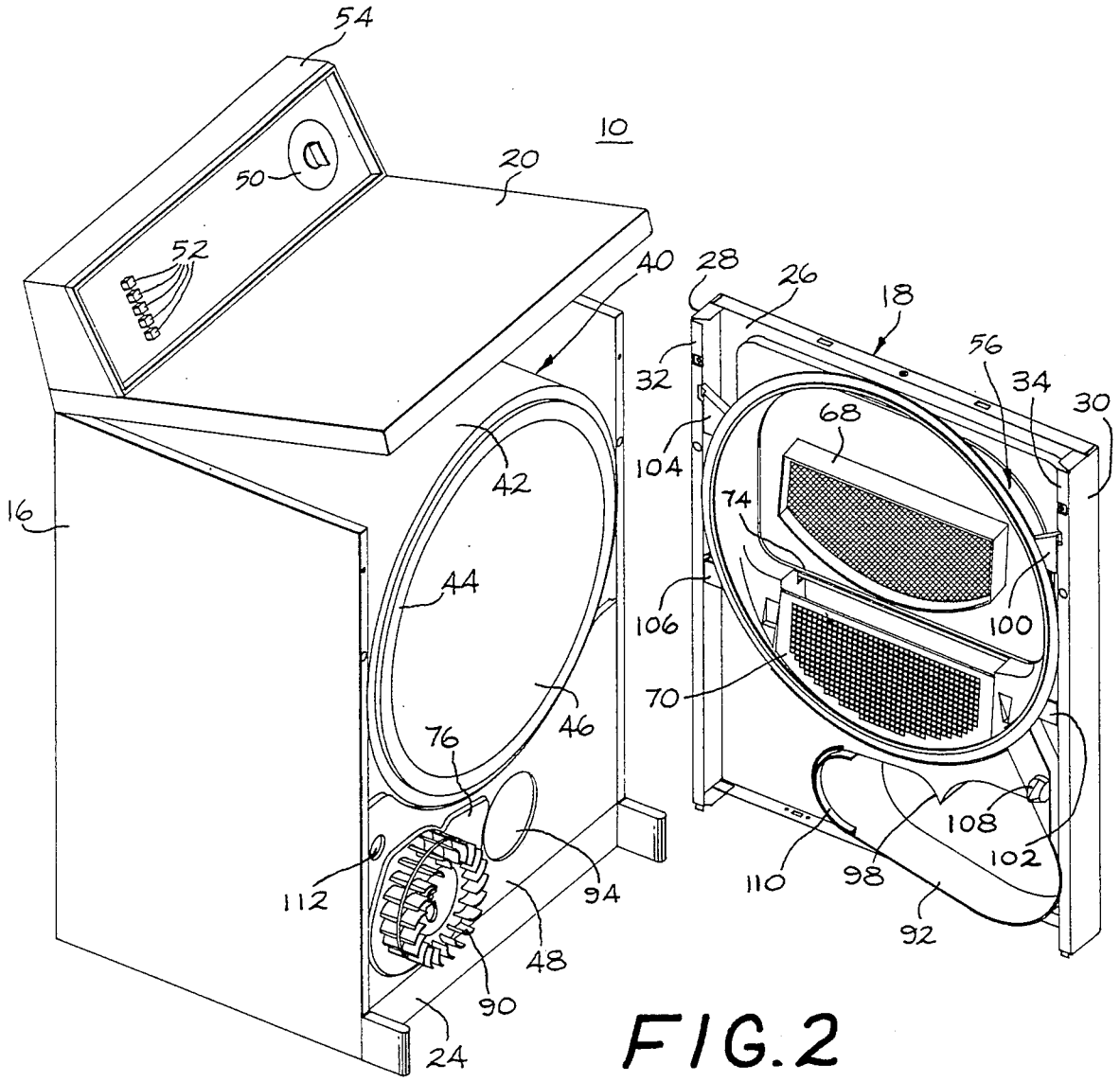
FIG. 2 is a somewhat schematic, front perspective view of the fabric dryer of FIG. 1 with the front panel of the dryer housing folded out.
Figure 3:
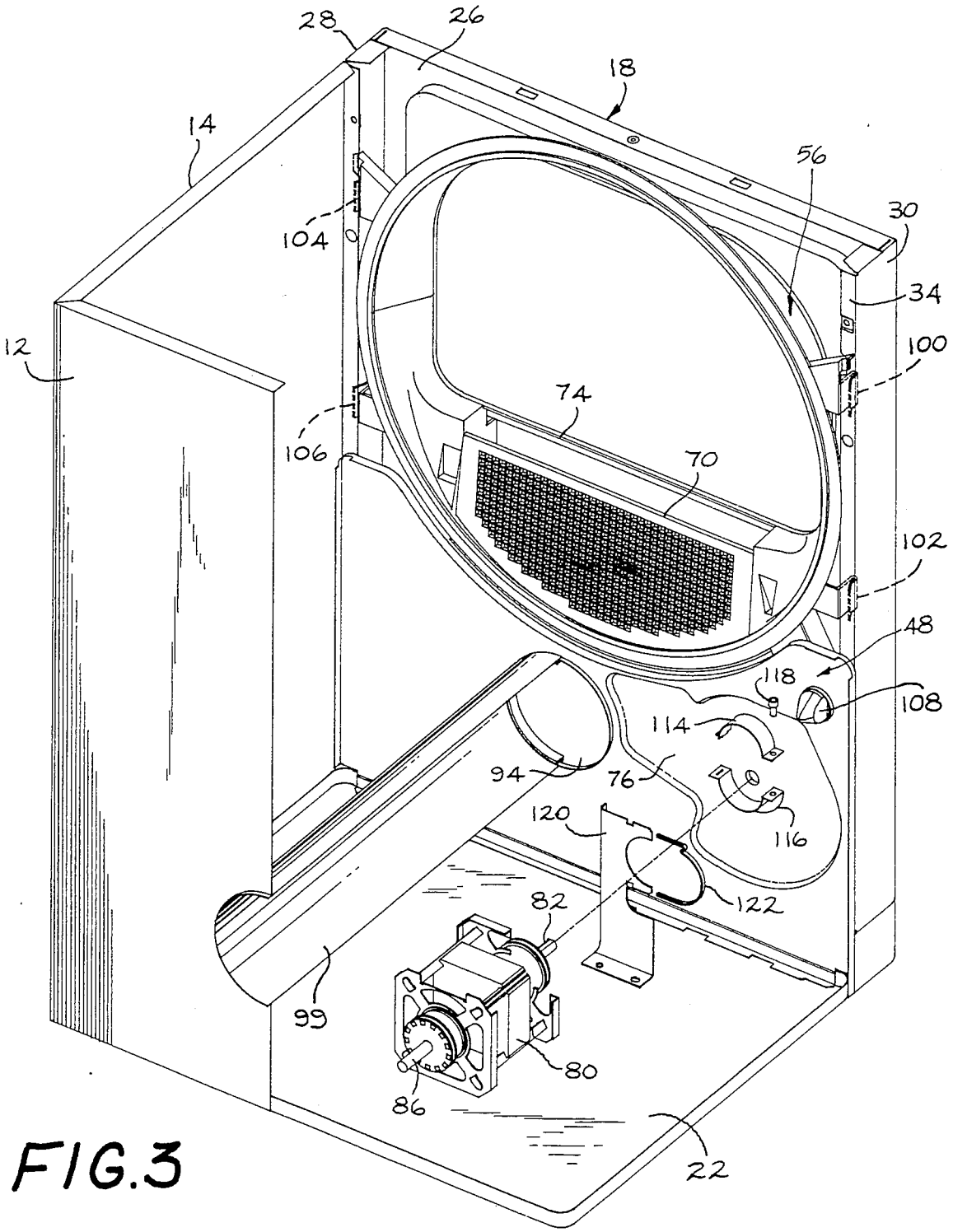
FIG. 3 is a somewhat schematic, partly broken away rear perspective view of the dryer of FIG. 1 with the top, drum and certain other parts removed for ease of reference.
Figure 4:
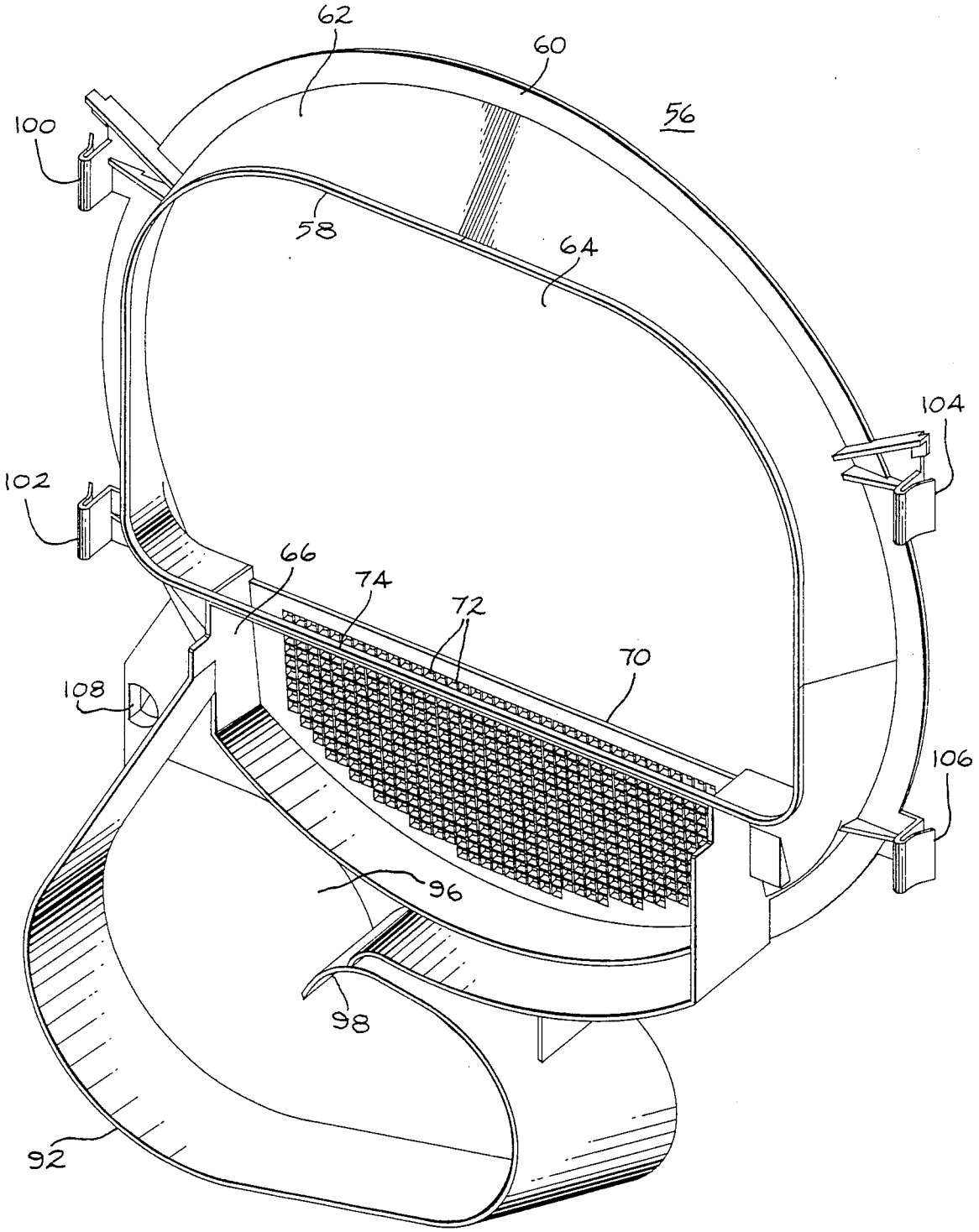
FIG. 4 is a perspective view of the unitary seal support structure of the dryer of FIG. 1.

As best seen in FIGS. 2 and 3, the front panel 18 includes a front wall 26 and a pair of rearwardly projecting side flanges 28 and 30. Each of the side flanges terminates in an inwardly projecting lip, 32 and 34 respectively. The front wall 26 is formed with an opening 36 surrounded by a range 38 to provide access to the interior of the machine. A door, normally mounted on the front wall 26 to selectively close the opening 36, has been omitted from the drawings for the sake of simplicity.

A fabric tumbling drum 40 is mounted for rotation on a substantially horizontal access within the dryer housing. The drum 40 is generally cylindrical in shape, has an imperforate outer cylindrical wall 42 and a front flange or wall 44 defining a drum opening 46. When the dryer is assembled the drum opening 46 registers with the opening 36 in the front wall 26 of the dryer housing, permitting clothes and other fabrics to be loaded into and removed from the dryer. A plurality of clothes tumbling ribs (not shown) normally are provided on interior of the cylindrical wall 42 to lift fabrics and then allow them to tumble back to the bottom of the drum as the drum rotates.

The drum 42 conventionally includes a rear wall (not shown) which is rotatably supported within the cabinet by a suitable fixed bearing means. The rear wall conventionally is perforated to admit drying air. The front of the drum is rotatably supported by a support panel 48 which is mounted within the cabinet just rearward of the drum front flange 44. Conveniently rollers or slides of low friction material (not shown) are mounted on the panel 48 and rotatively support the front of the drum 40. The drum 40 terminates rearwardly of the front wall 26 and thus the support panel 48 is mounted within the cabinet rearwardly of the front wall 26. In the illustrative embodiment, the support panel 48 is mounted in alignment with the front edges of side walls 14 and 16 and is attached to them and to the bottom panel 22 to contribute strength and stiffness to the cabinet or housing.

Conventionally air for drying the fabrics is heated either by electrical resistance heaters or by a gas fueled heat exchanger. A blower draws the heated air from rear to front through the drum to evaporate moisture from the fabrics in the drum and then expels the hot moist air out of the dryer housing and through a conduit to the outside atmosphere. As the heated air is drawn through the drum, the drum is rotated, normally by means of an electric motor. The operations of these various components are controlled by control means such as timer 50 and switches 52 mounted in the backsplash 54 at the rear of the top panel 20. These various operating components may be conventional in nature and have been omitted for the sake of simplicity.

The space between the drum front flange 44 and the front wall 26 is bridged by a unitary seal support structure or intermediate bridging member 56. The bridging member includes a D-shaped flange 58, dimensioned to fit closely around the flange 38 defining the opening 36 through the front wall 26, and a circular sealing rim 60. The sealing rim 60 is dimensioned to closely abut and be coextensive with the front flange 44 of drum 40. The rim 60 may rub directly against the flange 44 as the drum rotates or, if desired, a low friction gasket material may be attached to the rim 60 to engage the flange 44. A circumferential wall or baffle 62 extends between the flange 58 and the rim 60 to provide a substantially continuous baffle between front wall 26 and drum 40. Thus, when the intermediate member is mounted in the dryer between the front wall 26 and drum 40, an opening 64 is provided permitting the user access to the interior of the drum for inserting and removing clothes and other fabrics. At the same time the circumferential edge of this opening is substantially blocked by baffle 62, preventing inadvertent passage of fabrics out of the drum into the working area of the dryer.

The lower portion of the baffle 62 is formed as a pocket 66 to receive and support a lint filter 68. A grille 70 extends across the face of the pocket 66 exposed to the interior of the drum and includes relatively large air passages 72. A strengthening bar 74 extends across the opposite side of the pocket 66. The filter 68 is received in the pocket and confined by the grille 70 and the bar 74. During operation, air flowing through the drum 40 then flows through the grille 70 and filter 68 as it exits the dryer. Since the air passages 72 through the grille are relatively large they do not trap lint and thus the grille prevents fabrics being dried from rubbing against the filter and picking up lint which has been filtered out of the airstream.

Conveniently a blower mechanism and associated ductwork is provided for drawing air through the drum and filter and then discharging it from the dryer housing. In accordance with the present invention there is provided an improved blower arrangement effectively utilizing a tangential blower. Referring now particularly to FIGS. 1–3 the support panel is formed with an embossed or raised area 76 including a small opening 78. A drive motor 80 is mounted rearwardly of the support panel 48 and advantageously may be mounted to the embossed area 76. Conveniently the motor is mounted to support panel 48 by suitable means such bracket members 114 and 116 which are connected about the front of motor 80 by screw 118. Lower bracket member 116 is connected to embossed area 76 by some suitable means such as spot welding. The rear of motor 80 is supported by a bracket or foot 120 and is secured to the foot by a "C" Clamp 122. The blower drive shaft 82 extends through the opening 78. A drum drive shaft 86 extends from the other end of the motor 80. A pulley (not shown) is mounted for rotation with shaft 86 and rotates the drum through a belt (not shown).

A tangential or transverse blower wheel is mounted to the blower drive shaft 82 for rotation therewith forwardly of the support panel 48. The bridging member 56 includes an elongated arcuate wall 92 shaped generally to conform to the edge of the embossed portion 78 and to encompass an opening 94 in the support panel 48. The elongated wall 92 extends between and tightly buts against the support panel 48 and the front wall 26 and, together with them, forms the housing for the blower incorporating the blower wheel 76 and an exit conduit for air leaving the blower housing. The elongated wall 92 is discontinuous at 96, providing an opening for air entering the blower. The edge of the wall adjacent the discontinuity 96 is turned inwardly to form a lip 98 positioned adjacent the edge of the blower wheel 90. This lip serves as a stripper or dam which divides the air between that entering opening 96 and that exiting to opening 94. The blower housing may be considered the area within wall 92 around the blower 90 and the exit conduit the area within the wall 92 between the stripper 98 and the opening 94. This construction provides a compact, powerful blower mechanism which utilizes components existing for other purposes to form the blower housing and exit conduit. Air exiting through the opening 94 is conducted by an exhaust conduit 99 to the rear of the dryer so that it may be exhausted to the outside atmosphere.

The member 56 is formed with four flexible tabs or tangs 100, 102, 104 and 106 respectively, a tapered dowell or pin 108 and an arcuate wall 110. The support panel 48 is formed with a mounting hole 112 sized to fit closely around the dowell 108.

When the dryer is assembled the intermediate member 56 is first mounted on the front panel 18 with the flange 58 of the intermediate member fitting around the lip 38 of the front panel 18 and with the four tabs 100–106 captured between the front wall 26 and the lips 32 and 34 respectively and with the ends of tabs confined by the side flanges 28 and 30 respectively. The front panel 18 then is attached to the front edges of the side walls 14 and 16 by suitable means such as screws (not shown). As the front panel comes into contact with the side walls the dowell 108 enters the hole 112 and the arcuate wall or lip 110 enters the opening 94.

The foregoing is a description of a preferred embodiment of the present invention. In accordance with the patent statutes, changes may be made in the disclosed construction and the method in which it is employed without actually departing from the true spirit and scope of the invention as defined in the appended claims.

What is claimed is:

1. A fabric dryer including:

a dryer housing having a rear wall, a pair of spaced apart side walls and a front wall;

a fabric receiving drum mounted in said housing for rotation about a generally horizontal axis; the front of said drum defining a drum opening spaced from said housing front wall;

a support panel positioned rearwardly of said front wall and supporting the front of said drum;

a blower mechanism for drawing air through said drum and discharging the air from said dryer housing; said blower mechanism including a drive motor mounted rearward of said support panel and a tangential flow blower wheel mounted forward of said support panel and driven by said motor; and means, including said support panel, providing a blower housing containing said blower wheel.

2. A fabric dryer as set forth in claim 1 wherein said blower housing defines an inlet for said blower housing in air flow communication with said drum opening.

3. A fabric dryer as set forth in claim 1 wherein said support panel defines an opening enabling air exiting said blower housing to pass to the rear of said support panel.

4. A fabric dryer as set forth in claim 3 further including discharge conduct means for conducting air from said support panel opening to the exterior of said dryer housing.

5. A fabric dryer as set forth in claim 1 wherein said means providing said blower housing further includes a bridging member extending between said dryer housing front wall and said support panel.

6. A fabric dryer as set forth in claim 5 wherein said bridging member includes an elongated wall extending between and engaging said dryer housing front wall and said support panel, said elongated wall having a discontinuity providing a blower housing inlet in air flow communication with said drum opening.

7. A fabric dryer as set forth in claim 1 further including means mounting said drive motor on said support panel.

8. A fabric dryer including:

a housing having a rear wall, a pair of spaced apart side walls and a front wall;

a fabric receiving drum mounted in said housing for rotation about a generally horizontal axis; the front of said drum defining a drum opening spaced from said housing front wall;

a support panel positioned rearwardly of said front wall and supporting the front of said drum;

a blower mechanism for drawing air through said drum and discharging the air from said dryer housing; said blower mechanism including a drive motor mounted rearward of said support panel and a tangential blower wheel mounted forward of said support panel and driven by said motor; and a bridging member extending between said dryer housing front wall and said support panel forming therewith a blower housing containing said blower wheel.

9. A fabric dryer as set forth in claim 8 wherein;

said support panel defines an opening enabling air exiting said blower housing to pass to the rear of said support panel; and said bridging member includes an elongated wall extending between and engaging said dryer housing front wall and said support panel and encompassing said blower wheel and support panel opening to form said blower housing and a blower exit conduit for air flow to said support panel opening.

10. A fabric dryer as set forth in claim 9 wherein said elongated wall has a discontinuity providing a blower housing inlet in air flow communication with said drum opening.

11. A fabric dryer as set forth in claim 10 wherein said elongated wall includes a lip positioned adjacent to said blower wheel for separate air entering said blower housing inlet and air exiting said blower housing to said blower exit conduit.

12. A fabric dryer as set forth in claim 8 further including means supporting said drive motor from said support panel.

* * * * *